US006259368B1

(12) United States Patent
Ruhrig

(10) Patent No.: US 6,259,368 B1
(45) Date of Patent: Jul. 10, 2001

(54) ELEMENT FOR SECURING ARTICLES ELECTRONICALLY OR FOR SENSOR TECHNOLOGY

(75) Inventor: Manfred Ruhrig, Weinheim (DE)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/288,102

(22) Filed: Apr. 8, 1999

(30) Foreign Application Priority Data

Apr. 8, 1998 (DE) ..... 198 15 583

(51) Int. Cl.[7] ..... G08B 13/14
(52) U.S. Cl. ..... 340/572.6; 340/572.3
(58) Field of Search ..... 340/572.3, 572.1, 340/572.6, 572.2, 551, 568.1; 428/611

(56) References Cited

U.S. PATENT DOCUMENTS 4,686,154 * 8/1987 Mejia ..... 428/611
4,829,288 * 5/1989 Eisenbeis ..... 340/551
4,882,569 * 11/1989 Dey ..... 340/572.2
4,940,966 * 7/1990 Pettigrew et al. ..... 340/551
5,554,974 * 9/1996 Brady et al. ..... 340/572.6
5,835,016 * 11/1998 Ho et al. ..... 340/568.1
6,023,226 * 2/2000 Morin et al. ..... 340/572.1

FOREIGN PATENT DOCUMENTS

19604746A1 8/1997 (DE) .
0762354A1 3/1997 (EP) .
0773523A1 5/1997 (EP) .

* cited by examiner

*Primary Examiner*—Benjamin C. Lee
(74) *Attorney, Agent, or Firm*—Jones, Tullar & Cooper, P.C.

(57) ABSTRACT

The present invention relates to an element for electronically securing articles or for sensor technology, comprising a striplike or wirelike Barkhausen material of given length, which in an external alternating magnetic field is excited to emit a characteristic signal, and a soft magnetic material which is associated with the Barkhausen material. The soft magnetic material comprises individual portions of a predetermined length, which are disposed at a predetermined spacing from one another, and that the portions of the soft magnetic material are positioned relative to the Barkhausen material such that the magnetic stray fields they generate couple with the magnetization of the Barkhausen material.

12 Claims, 3 Drawing Sheets

ELEMENT FOR SECURING ARTICLES ELECTRONICALLY OR FOR SENSOR TECHNOLOGY

FIELD OF THE INVENTION

The present invention relates to an element for electronically securing articles or for sensor technology, comprising a striplike or wirelike Barkhausen material of given length, which in an external alternating magnetic field is excited to emit a characteristic signal, and a soft magnetic material which is associated with the Barkhausen material.

BACKGROUND OF THE INVENTION

Elements of Barkhausen material—also known as pulse wires—are used both for electronically securing articles and for so-called pulse wire sensors in sensor technology. They are distinguished by a virtually rectangular hysteresis curve; that is, the reversal of magnetization in an outer alternating magnetic field takes place virtually abruptly as soon as the exciter field has reached the predetermined threshold value. Elements suitable for electronically securing articles are described for instance in U.S. Pat. Nos. 4,247,601 and 4,660,025 and European Patent Disclosures EP 0 309 679 B1 and EP 0 762 354 A1.

The abrupt reversal of magnetization of wirelike or striplike Barkhausen materials in an external alternating field is the consequence of a pronounced monoaxial anisotropy along the longitudinal axis of the wire or strip. This anisotropy suppresses not only disruptive rotational processes during the magnetization reversal but also the formation of terminal domain structures before the switching field intensity is attained. After all, the formation of such structures would cause a rounding off of the hysteresis curve and thus would worsen the switching characteristics.

The anisotropy required to form a markedly rectangular hysteresis curve can have various causes. Methods have become known from the patent literature that utilize voltage-induced anisotropy (U.S. Pat. No. 4,660,025) or magnetic field-induced anisotropy (EP 0 762 354 A1). However, it is common to all these methods that to support the induced anisotropies, a pronounced formal anisotropy, in order to attain the pronounced switching behavior is necessary. Shortening the strips or wires, which as a rule are elongated, causes a decrease in the formal anisotropy and an increase in the demagnetization effect, which reduces the rectangular shape of the hysteresis curve.

Increasing the intrinsic anisotropy, as proposed for instance in EP 0 762 354 A1 for labels of short length, would indeed at least partly compensate for the decrease in formal anisotropy or the increase in the demagnetization factor; however, at the same time it would lead to an increase in the switching field intensity, which is undesired for the application in systems for electronically securing articles.

From the patent literature, alternative ways have already become known for how the demagnetizing field in the end regions of the Barkhausen material, which after all causes the undesired magnetization reversal processes, can be suppressed. For instance, in European Patent Disclosure EP 0 710 923 A2, a magnetic marking element is described, which comprises a thin magnetic wire of Barkhausen material, in the two end regions of which two soft magnetic chips are disposed that have a lower coercive force than the Barkhausen material wire. To increase the pulse height, the chips cover the ends of the strips and preferably protrude past the ends to all sides.

From EP 0 762 354 A1, it has become known to use an amorphous band or an amorphous wire of Barkhausen material as a securing element for electronically securing articles. To increase the pulse height, at least one further strip of soft magnetic material is associated with the amorphous material and preferably protrudes past the ends of the amorphous material.

Both of these versions in the prior art have the disadvantage of being unsuitable for continuous production of bands from which labels of varying length are later stamped out. The reason for this is that the soft magnetic strips must be positioned at the ends of the labels, yet as a rule the position cannot be determined during production.

SUMMARY OF THE INVENTION

The object of the present invention is to provide an economical element for electronically securing articles or for sensor technology that does not have the above disadvantages.

This object is attained in that the portions of soft magnetic material are positioned relative to the Barkhausen material such that the magnetic stray fields they generate couple with the magnetization of the Barkhausen material.

By means of the stray field coupling, a stabilization of the prestressed wirelike or striplike Barkhausen material is brought about. By disposing the soft magnetic portions along the striplike or wirelike Barkhausen material, the internal field of the element is reduced, and not only—as described in the prior art—in the end regions. As a result—as will be described in further detail below—the actual switching range is stabilized in a targeted way until the intrinsic switching field intensity is reached, which is finally determined by induced anisotropies and thus by the domain wall mobility.

Since in accordance the present invention it is unnecessary for the ends of the wirelike or striplike Barkhausen material to be covered, the corresponding securing elements can be manufactured in the form of continuous bands. From the bands, labels with a length needed for the particular application can then be stamped out.

An especially favorable method for producing the securing elements according to the present invention is described in German Patent Disclosure DE 196 31 852 A1. Although the method disclosed in this prior art relates to the production of deactivatable soft magnetic strip elements, nevertheless if the activatable soft magnetic material of this Published, Unexamined German Patent Application is replaced by striplike or wirelike Barkhausen material, and if the semihard or hard magnetic deactivator material is replaced with soft magnetic material, then the method that has been disclosed can be adopted analogously to the production of the securing elements of the present invention. The disclosure content of DE 196 31 852 A1 is hereby expressly incorporated into the description of the present invention.

It is understood that the element according to the invention for securing articles or for sensor technology can also be made by any other methods that have become known for producing deactivatable strip elements. One example that can be mentioned in particular is the production method described in European Patent Disclosure EP 0 690 011 A1.

To optimize the coupling of the portions of the soft magnetic material with the Barkhausen material, it is proposed that the portions of the soft magnetic material be disposed on the Barkhausen material.

In a preferred feature of the element of the present invention, it is provided that the portions of the soft magnetic material and the Barkhausen material have substantially the same width. It is also proposed that the portions of the soft magnetic material are distributed substantially uniformly over the length of the Barkhausen material.

For use as pulse wires in sensors, the element according to the present invention has the advantage that the ends are not covered.

It thus becomes possible to keep the spacing between the actual sensor and the field source slight. Precisely in such sensors but to an increasing extent also in elements for electronically securing articles (especially small articles), one feature of the switch element according to the present invention can be considered especially favorable, in which—as already noted—the length of the striplike or wirelike Barkhausen material is selected to be relatively short. By adapting the length, spacing and permeability of the portions of the soft magnetic material, the characteristic signal of the element can be optimized for the applicable length of the Barkhausen material. Thus the version according to the present invention makes it possible to shorten the length of the Barkhausen elements, known from the prior art, by approximately one-half, without drastically increasing the switching field intensity. This necessarily leads to considerable savings of material, making the securing elements of the present invention relatively economical. This effect is also reinforced by the above-described, simple and economical manufacturing methods.

In order to make the securing or sensor elements of the present invention deactivatable, an advantageous refinement proposes that portions of a semihard magnetic or hard magnetic material are provided, which are disposed in the immediate vicinity of the Barkhausen material and of the portions of the soft magnetic material.

One feature of a deactivatable element according to the present invention provides that the portions of the soft magnetic material and the portions of the semihard or hard magnetic material are disposed in alternating succession with one another along the length of the Barkhausen material.

In an advantageous refinement of the element of the present invention for electronically securing articles or for sensor technology, it is provided that the portions of the soft magnetic material and the portions of the semihard or hard magnetic material and the Barkhausen material all have substantially the same width.

The present invention will be described in further detail in conjunction with the following figures. Shown are:

DESCRIPTION OF THE PREFERRED EMBODIMENTS

Figure 1:
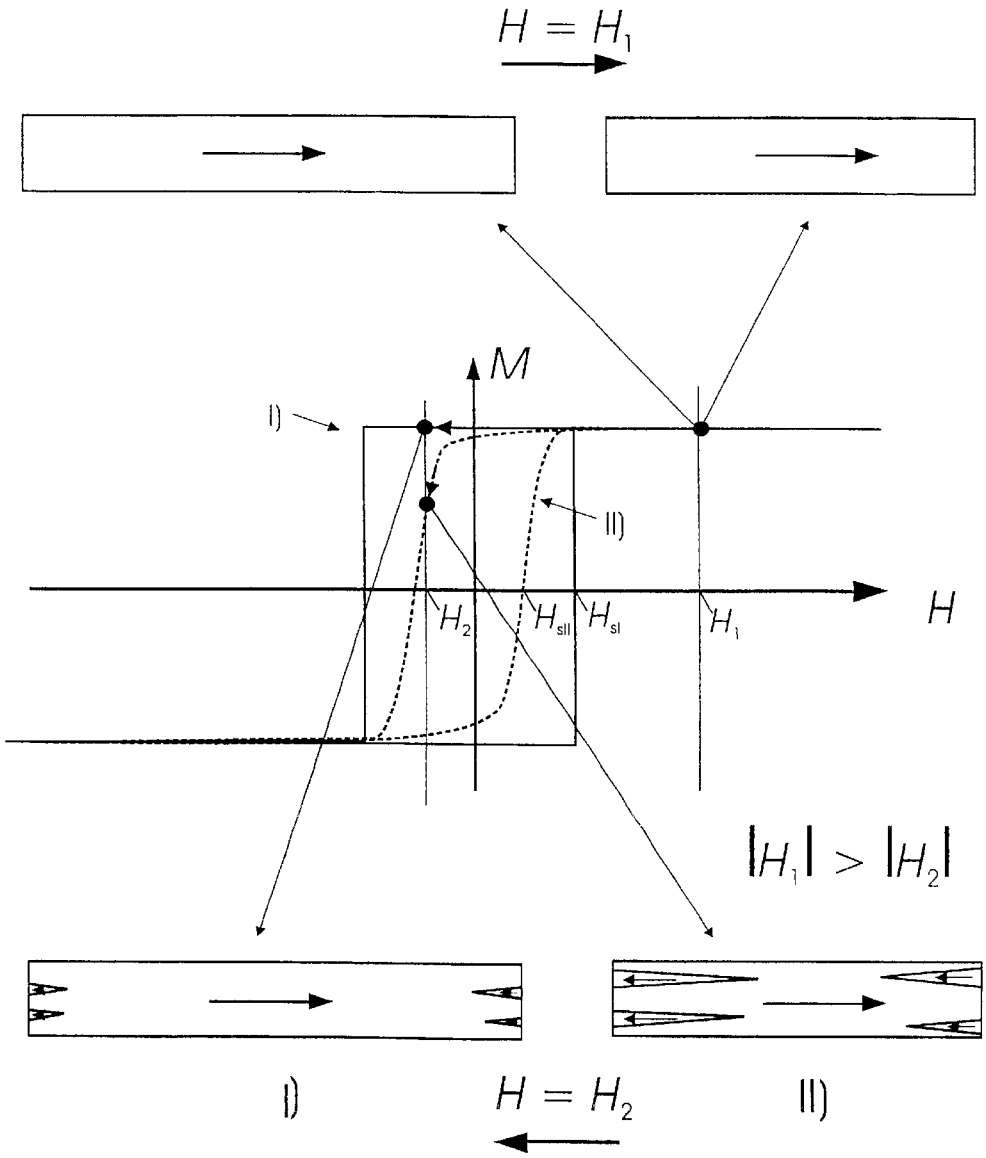
FIG. 1: is a schematic illustration of the switching behavior of known Barkhausen elements of various lengths.

FIG. 1 shows a schematic illustration of the switching behavior of known Barkhausen elements of various lengths in an M-H graph. While the hysteresis curve of the longer Barkhausen element—represented by (I)—extends virtually rectangularly and thus reverses its magnetization abruptly upon reaching the applicable switching field intensities, the shorter Barkhausen element—identified by (II)—has a hysteresis curve that deviates considerably from the desired rectangular form. The reversal of magnetization no longer takes place suddenly here at a predetermined field intensity of the external magnetic field H but rather continuously, while the external magnetic field passes through a certain range.

The magnetization in the Barkhausen elements is shown, coming from the saturated state in the field H1, in the lower region of the drawing upon reaching the field intensity H2. While in the case of the longer Barkhausen element the reversal of magnetization of the peripheral regions is negligibly slight, in the shorter Barkhausen element, because of the increased demagnetizing effect, it already occurs markedly before the actual switching field intensity Hs is reached. The consequence of this is that the magnetization reversal process of the shorter element proceeds far less suddenly than for the longer element. As a result, the probability of detection in electronic article monitoring systems, which is based on the generation of higher harmonics of the fundamental frequency of the interrogating field, is drastically reduced.

Figure 2:
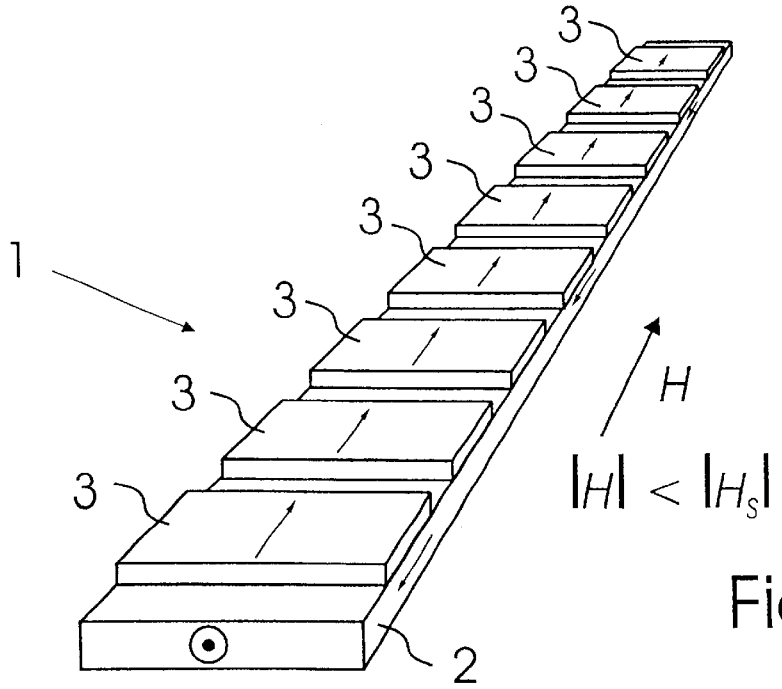
FIG. 2: is a perspective view of one embodiment of the element according to the present invention for electronically securing articles or for sensor technology.
Figure 3:
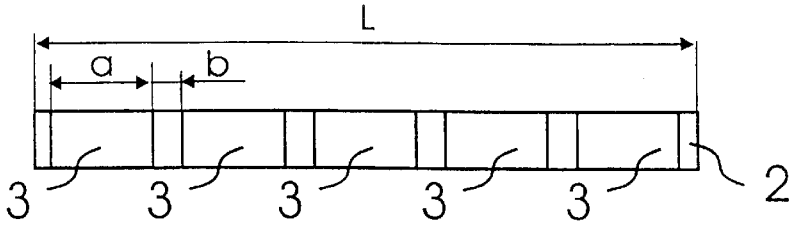
FIG. 3: is a plan view on the embodiment shown in FIG. 2.

FIG. 2 in a perspective view shows an embodiment of the element of the present invention for electronically securing articles or for sensor technology. FIG. 3 shows this embodiment in plan view. Portions 3 of a soft magnetic material of length a are disposed at the spacing b from one another on a striplike Barkhausen material 2. By means of this embodiment of the present invention, a stabilization of the prestressed Barkhausen material 2 is attained as a consequence of stray field couplings. By purposeful optimization of the permeability P, the length a and the spacing b of the portions 3 of the soft magnetic material, the switching behavior even of relatively short Barkhausen elements 1 can be improved decisively, without necessitating an undesired increase in the intrinsic switching field intensity. The term "intrinsic switching field intensity" here means the switching field intensity of an "infinitely" long Barkhausen element.

Figure 4:
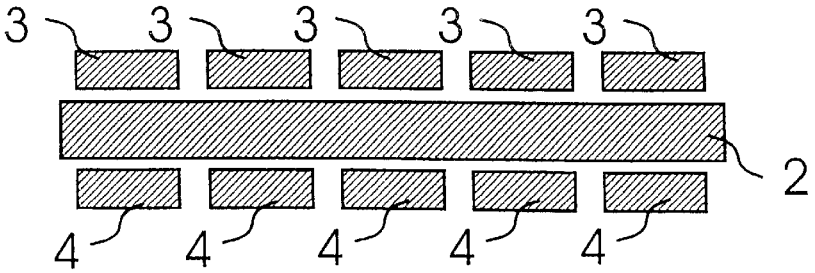
FIG. 4: is a cross section through a second, deactivatable embodiment of the element of the present invention.

A deactivatable embodiment of the element 1 of the invention is shown in cross section in FIG. 4. Portions 3 of length a of soft magnetic material are disposed at the spacing b from one another on the striplike Barkhausen material 2. Portions 4 of a semihard or hard magnetic material are disposed under the striplike Barkhausen material 2. The portions 4 serve in a known manner to deactivate the security element 1. If such a high magnetic field is applied to the security element 1 that the portions 4 of the semihard or hard magnetic material are forced into saturation, then they subsequently suppress any reaction by the Barkhausen material 2 to the external magnetic poling field H.

Figure 5:
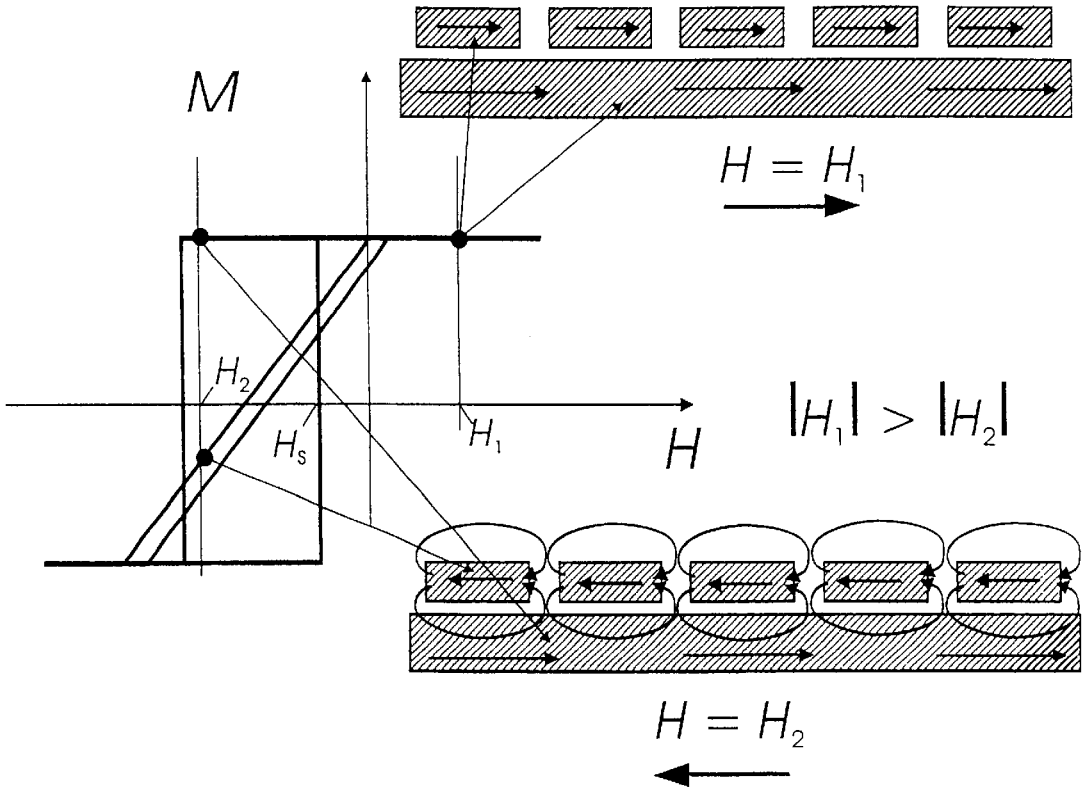
FIG. 5: is a schematic illustration of the switching behavior of the element of the present invention for electronically securing articles or for sensor technology.
Figure 6:
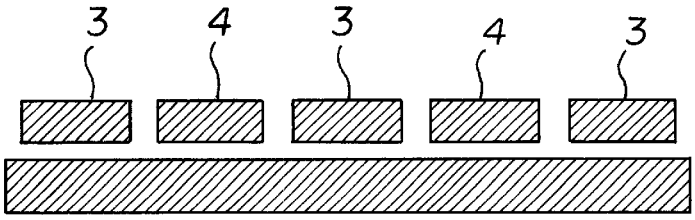
FIG. 6: shows the alternating succession embodiment.

FIG. 5 shows a schematic illustration of the switching behavior of the element 1 of the present invention for electronically securing articles or for sensor technology. While the striplike or wirelike Barkhausen material 2 on its own has the rectangular hysteresis curve already mentioned several times, the hysteresis curve of the portions 3 of the soft magnetic material have a typically sheared form. The version according to the present invention is distinguished now precisely in that a striplike or wirelike Barkhausen material 2 of slight length L is used. Without the portions 3 of the soft magnetic material disposed on the Barkhausen material 2, the hysteresis curve would have the rounded form (hysteresis curve II) shown in FIG. 1. By the regular disposition of the portions 3 of the soft magnetic material on the Barkhausen material, the prestressed Barkhausen material 2 is stabilized as a consequence of the stray field coupling. Thus even the short Barkhausen element 1 has a rectangular hysteresis curve and consequently exhibits the desired switching behavior upon the application of an external alternating magnetic field H.

What is claimed is:

1. An element for electronically securing articles or for sensor technology produced by cutting a continuous band of striplike or wirelike Barkhausen material into pieces of a given length, comprising:

a soft magnetic material which is associated with the pieces of the striplike or wirelike Barkhausen material of a given length, wherein the soft magnetic material comprises individual portions of a predetermined length, which are disposed at a predetermined spacing from one another and substantially uniformly over the length of the Barkhausen material, and said individual portions of said soft magnetic material have substantially the same width as the Barkhausen material and are positioned relative to said striplike or wirelike Barkhausen material such that the magnetic stray fields they generate couple with the magnetization of said striplike or wirelike Barkhausen material.

2. The element of claim 1, wherein said individual portions of said soft magnetic material are disposed on the Barkhausen material.

3. The element of claim 1, wherein said individual portions of said soft magnetic material and said striplike or wirelike Barkhausen material have substantially the same width.

4. The element of claim 1, wherein said individual portions of said soft magnetic material are distributed substantially uniformly over the length of said striplike or wirelike Barkhausen material.

5. The element of claim 1, wherein the length of said striplike or wirelike Barkhausen material is selected to be as short as possible, and wherein the length, spacing and permeability of said individual portions of said soft magnetic material are adapted so that the characteristic signal of the element is optimized for the applicable length of said striplike or wirelike Barkhausen material.

6. The element of claim 1, wherein portions of a semihard magnetic or hard magnetic material are provided, which are disposed in the immediate vicinity of said striplike or wirelike Barkhausen material and of said individual portions of said soft magnetic material.

7. The element of claim 6, said individual portions of said soft magnetic material and said portions of said semihard or hard magnetic material are disposed in alternating succession with one another along the length of said striplike or wirelike Barkhausen material.

8. The element of claim 6, wherein said individual portions of said soft magnetic material and said portions of said semihard or hard magnetic material and said striplike or wirelike Barkhausen material all have substantially the same width.

9. A method of producing an element for electrically securing articles or for sensor technology, comprising the steps of:

forming a continuous band of a striplike or wirelike Barkhausen material;

disposing individual portions of a predetermined length of a soft magnetic material at a predetermined spacing from one another and substantially uniformly over the length of the Barkhausen material, wherein said individual portions of said soft magnetic material have substantially the same width as the Barkhausen material and are positioned relative to said striplike or wirelike Barkhausen material such that the magnetic stray fields they generate couple with the magnetization of said striplike or wirelike Barkhausen material; and cutting the continuous band of a striplike or wirelike Barkhausen material provided with the portions of soft magnetic material into said elements of a given length.

10. The method of claim 9, wherein the step of cutting the continuous bands is carried out at random positions.

11. An element for electronically securing articles or for sensor technology produced by the method of claim 9.

12. An element for electronically securing articles of for sensor technology produced by the method of claim 10.

* * * * *